US009021852B2

(12) United States Patent
Zhang

(10) Patent No.: US 9,021,852 B2
(45) Date of Patent: May 5, 2015

(54) PRESSING AND STRIPPING APPARATUS FOR PUNCH DIE AND PUSH ROD THEREOF

(76) Inventor: Forward Zhang, Shenzhen (CN)

( * ) Notice: Subject to any disclaimer, the term of this patent is extended or adjusted under 35 U.S.C. 154(b) by 159 days.

(21) Appl. No.: 13/807,767

(22) PCT Filed: Dec. 6, 2010

(86) PCT No.: PCT/CN2010/079459

§ 371 (c)(1),
(2), (4) Date: Dec. 31, 2012

(87) PCT Pub. No.: WO2012/000287

PCT Pub. Date: Jan. 5, 2012

(65) Prior Publication Data

US 2014/0007643 A1 Jan. 9, 2014

(30) Foreign Application Priority Data

Jun. 30, 2010 (CN) ..... 2010 1 0215356

(51) Int. Cl.

| | |
|---|---|
| ***B21D 53/28*** | (2006.01) |
| ***B21D 45/08*** | (2006.01) |
| ***B21D 28/34*** | (2006.01) |
| ***B21D 35/00*** | (2006.01) |
| ***B21D 28/24*** | (2006.01) |
| ***B21D 45/00*** | (2006.01) |

(52) U.S. Cl.

CPC ..... *B21D 45/08* (2013.01); *B21D 28/34* (2013.01); *B21D 35/001* (2013.01); *B21D 28/24* (2013.01); *B21D 45/006* (2013.01)

(58) Field of Classification Search

CPC ..... B21D 28/24; B21D 28/34; B21D 35/001; B21D 45/006; B21D 45/08

USPC ..... 72/328, 344, 427, 455

See application file for complete search history.

(56) References Cited

U.S. PATENT DOCUMENTS

| | | | | |
|---|---|---|---|---|
| 3,995,469 | A * | 12/1976 | Ames | 72/328 |
| 4,036,056 | A * | 7/1977 | Saunders | 72/329 |
| 4,118,968 | A * | 10/1978 | Ames | 72/328 |
| 4,839,952 | A * | 6/1989 | Yokoyama | 29/893.33 |

FOREIGN PATENT DOCUMENTS

CN 1149514 A * 5/1997

* cited by examiner

*Primary Examiner* — David B Jones

(74) *Attorney, Agent, or Firm* — Raymond Y. Chan; David and Raymond Patent Firm

(57) ABSTRACT

A pressing and stripping apparatus for punch die includes a base, a pressing and striping plate, an A-type pillar, a first bolt, an elastic or pressure element, a stripping bolt, a second bolt, a die-mounting bolt, a B-type pillar, a locating pin, a cylindrical guide column, a third bolt, an outer supporting frame, and a square guide column; wherein the pressing and stripping plate is movably connected to the base via the stripping bolt, wherein the pressing and stripping plate reciprocates along the axial direction of the stripping bolt while working, and the elastic or pressure element is provided between the pressing and stripping plate and the base. The push rod used with the pressing and stripping apparatus for the punch die is a column, one end thereof is a polygonal blind hole, and the other end thereof is a stepped shaft with parallel threads. This arrangement can achieve a common pressing and stripping apparatus, making the punch die easy to be disassembled.

11 Claims, 7 Drawing Sheets

PRESSING AND STRIPPING APPARATUS FOR PUNCH DIE AND PUSH ROD THEREOF

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a manufacturing filed of punch dies, and more particularly to a pressing and stripping apparatus for a punch die and a push rod thereof.

2. Description of Related Arts

A punch die for a punch press generally comprises of a convex-concave die, a pressing and stripping plate, a pressing and stripping functional element, a fixing plate, a liner plate, guide pins, a base, and iron pads. The pressing and stripping functional element of the punch die is often provided within the die, while a handful of bending dies are hung at outer side of the lower base. They have a one-to-one configuration and are not interchangeable. Current pressing and stripping functional elements are all resilient elements such as casting polyurethane, rubber and metal springs, or nitrogen springs; wherein the features of the casting polyurethane, rubber and metal spring are that the initial pressure is zero and the pressing force is in direct proportion with the amount of compression. Therefore, the spring should be pre-pressed with an amount of compression being 5-8% of the length of the spring in order to obtain an initial pressure. The amount of compression of every type of resilient element is predetermined, for example, the effective amount of compression for a commonly used heavy load spring SWB (A spring serial number of a Japanese company MISUMI) in a punch die is 20% of the spring length. This means that the amount of compression in use with the SWB spring is about 12-15% of the length, so that the length of the SWB spring usually is larger than 50 mm. The nitrogen spring is a single piston rod pneumatic cylinder with preset compressed nitrogen. The advantage of a nitrogen spring is that the initial pressure is relatively large, but its length is often larger than 100 mm. The die should be designed to have a relatively large thickness so that these pressing and stripping functional elements can be installed in the upper and lower mould of the die. As a result, the die is bulky in size and it is a large waste of high quality steel materials.

With the development of the material living standard of the human beings, the upgrading and replacing of the products becomes more and more frequent. The production life of a single machine type of many mechanical and electrical products such as CD players, VCD players, DVD players, and TV sets has decreased from over a million in the 80s and 90s to tens of thousands at present. Accordingly, dies for manufacturing the products also have to be upgraded and replaced frequently. According to international convention, dies for mechanical and electric products which have stopped production should be preserved carefully for five to seven years in the case that there is a need to produce a few and a handful of spare parts. Therefore, during the past ten years many factories have stored large quantities of dies which have been placed out of service. Accompanying with the more and more increasing requirement for a low carbon economy as well as for energy-saving and emission-reduction; simplifying the structure of the die, and reducing the manufacturing period and manufacturing cost of the die while ensuring that the function of the die in use will not change have become a new trend for the development of dies in the future.

SUMMARY OF THE PRESENT INVENTION

The invention is advantageous in that it provides a pressing and stripping apparatus for a punch die and a push rod of the pressing and stripping apparatus for a punch die, the technical problem to be solved is to isolate the one-to-one configured pressing and stripping functional element from the punch die in order to provide a generalized pressing and stripping apparatus, so that the die is easy to be disassembled, and can be repeatedly used for a long period of time. The structure is simple, the weight is light, and the manufacturing period is shortened and the manufacturing costs are decreased.

Additional advantages and features of the invention will become apparent from the description which follows, and may be realized by means of the instrumentalities and combinations particular point out in the appended claims.

According to the present invention, the foregoing and other objects and advantages are attained by a pressing and stripping apparatus for a punch die, comprising: a base, a pressing and striping plate, an A-type pillar, a first bolt, an elastic or pressure element, a stripping bolt, a second bolt, a die-mounting bolt, a B-type pillar, a locating pin, a cylindrical guide column, a third bolt, an outer supporting frame, and a square guide column; wherein the pressing and stripping plate is connected to the base, wherein the pressing and stripping plate is movably connected to the base via the stripping bolt, wherein the elastic or pressure element is provided between the base and the pressing and stripping plate, wherein first ends of the A-type pillar, the B-type pillar, the cylindrical guide column, and the square guide column are firmly connected to the base while second ends thereof are passed respectively through holes in the pressing and stripping plate, wherein the die-mounting bolt, which is internally installed in a central axial hole of the base and the B-type pillar, is capable of moving upward and downward as well as rotating to firmly mount the pressing and stripping apparatus for a punch die on the die when in operation; the elastic or pressure element is selected from a group consisting of a metal spiral spring, a nitrogen spring, a pneumatic cylinder modular arrangement with a single piston rod, and hydraulic cylinder with a single piston rod, wherein the A-type pillar and the B-type pillar are installed on the base with a grid shaped distribution configuration, wherein the outer supporting frame, which is cuboid shaped, surrounds the pressing and stripping plate, wherein the base is provided with a hoisting screw hole, wherein the locating pin is mounted on the pressing and stripping plate.

The base of the present invention is provided orderly with a first hole, a second hole, a third screwed hole, a fourth hole, a fifth hole, a twelfth hole and a hoisting screw hole, wherein the pressing and stripping plate is provided orderly with a sixth hole, a seventh hole, an eighth hole, a ninth hole, a tenth hole, and a guiding groove, wherein the first bolt, which passes through the second hole, is securely coupled with a central axial screwed hole of the A-type pillar, wherein an upper end of the A-type pillar is connected to the base while a lower end thereof passes through the sixth hole, wherein the stripping bolt passes through the seventh hole with screwed end thereof being firmly connected in the third screwed hole, wherein an upper end of the die-mounting bolt is provided in the fourth hole while a lower end thereof is provided in a central axial hole of the B-type is pillar, wherein a middle upper end portion thereof is provided with a block ring, and a whole body thereof is supported by a cylindrical steel wire compression spring provided in the central axial hole of the B-type pillar, wherein when the upper end thereof is under pressure the whole body moves downward and is capable of rotating along positive and negative directions with respect to an axial thereof so as to install the pressing and stripping apparatus for a punch die or detach the pressing and stripping apparatus for a punch die from the punch die, wherein the B-type pillar is connected and fixed on a bottom surface of the base via the second bolt while a lower end thereof is provided in the eighth hole, wherein the cylindrical guide column comprises a first end fixed and mounted in the fifth hole of the base, and a second end that passes through the tenth hole of the pressing and stripping plate, wherein an upper end of the third bolt is provided in the twelfth hole and a lower end thereof is firmly connected to a screw hole of the outer supporting frame, wherein the square guide column comprises a first end fixed and mounted in the first hole of the base, and a second end that passes through the guide groove at a lateral side of the pressing and stripping plate, wherein the locating pin is connected and fixed in the ninth hole.

The base, the pressing and stripping plate, or the base and the pressing and stripping plate of the present invention is/are provided with blind holes, wherein one end or two ends of the elastic or pressure element is/are provided in the blind holes.

The elastic or pressure element of the present invention is a pneumatic cylinder module with a single piston rod, wherein the pneumatic cylinder module with a single piston rod is firmly connected to the base via the third bolt, wherein a pipe module is provided on the base, wherein the pneumatic cylinder module with a single piston rod is connected to the pipe module, wherein the pressing and stripping apparatus for a punch die further comprises an external pressure adjusting system comprising a quick-change adapter, wherein the pipe module is connected to the quick-change adapter.

The external pressure adjusting system of the present invention comprises the quick-change adapter, a gas storing jar, a safety valve, a first pressure adjusting valve, a gas pump, a first counting meter, and a valve, wherein the quick-change adapter is connected to the gas storing jar, wherein the gas storing jar is respectively connected to the safety valve and the valve, wherein the gas storing jar is connected to the first pressure adjusting valve, wherein the first pressure adjusting valve is connected to the gas pump, wherein the first pressure adjusting valve is connected to the first counting meter.

The external pressure adjusting system of the present invention comprises the quick-change adapter, a two position three-ay directional control valve, a gas storing jar, a safety valve, a first pressure adjusting valve, a second pressure adjusting valve, a gas pump, a first counting meter, a second counting member, and a noise damping and gas discharging device, wherein the two position three-way directional control valve is respectively connected to the quick-change adapter and the gas storing jar, and is connected to the noise damping and gas discharging device through the second pressure adjusting valve, wherein the gas storing jar is respectively connected to the safety valve and the valve, and is connected to the gas pump through the first pressure adjusting valve, wherein the first pressure adjusting valve is connected to the first counting meter, wherein the second counting meter is connected to the second pressure adjusting valve.

The elastic or pressure element of the present invention is a hydraulic cylinder module with a single piston rod, wherein the hydraulic cylinder module with a single piston rod is firmly connected to the base via the third bolt, wherein a pipe module is provided on the base, wherein the hydraulic cylinder module with a single piston rod is connected to the pipe module, wherein the pressing and stripping apparatus for a punch die further comprises an external pressure adjusting system embodied as a quick-change adapter, wherein the pipe module is connected to the quick-change adapter.

The external pressure adjusting system of the present invention comprises the quick-change adapter, a booster, a gas storing jar, a safety valve, a valve, a first pressure adjusting valve, a first counting meter, and a gas pump, wherein the booster is connected with the quick-change adapter and the gas storing jar, wherein the gas storing jar is respectively connected to the safety valve, wherein the valve is connected to the gas pump through the first pressure adjusting valve, wherein the first counting meter is connected to the first pressure adjusting valve.

The external pressure adjusting system of the present invention comprises the quick-change adapter, a two position three way directional control valve, a throttling valve, a first spillover valve, a second spillover valve, a hydraulic pump, a filter, a first oil tank, a second oil tank, and a third oil tank, wherein the two-position three-way directional control valve is respectively connected to the quick-change adapter, wherein the throttling valve is connected to the third oil tank through the second spillover valve, wherein the throttling valve is connected to the second oil tank through the first spillover valve and is connected to the filter through the hydraulic pump, wherein the filter is connected to the first oil tank.

A push rod of a compressing and stripping apparatus for a punch die, wherein the push rod (91) is a column, wherein one end thereof is a polygonal blind hole, and the other end thereof is a stepped shaft with parallel threads.

Still further objects and advantages will become apparent from a consideration of the ensuing description and drawings.

These and other objectives, features, and advantages of the present invention will become apparent from the following detailed description, the accompanying drawings, and the appended claims.

BRIEF DESCRIPTION OF THE DRAWINGS

FIG. 9-1 is a schematic view of a push rod of the present invention.

FIG. 9-2 is a top view of the push rod.

FIG. 10-1 is a schematic view of An A-type pillar of the present invention.

FIG. 10-2 is a top view of the A-type pillar.

FIG. 10-3 is a schematic view of A B-type pillar of the present invention.

FIG. 10-4 is a top view of the B-type pillar.

FIG. 14-1 is a schematic view illustrating the placement of the A-type and B-type pillars of the present invention.

FIG. 14-2 is a top view illustrating the placement of the A-type and B-type pillars of the present invention.

DETAILED DESCRIPTION OF THE PREFERRED EMBODIMENT

The following description is disclosed to enable any person skilled in the art to make and use the present invention. Preferable embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
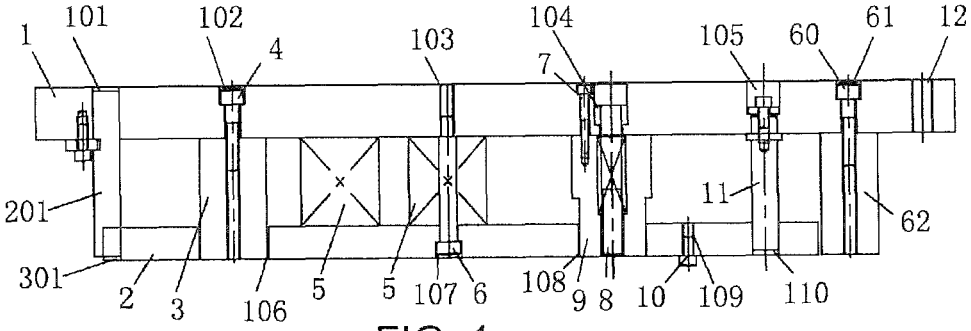
FIG. 1 is schematic view of the present invention.

Referring to FIG. 1 of the drawings, the pressing and striping apparatus for a punch die comprises a base 1, a pressing and striping plate 2, an A-type pillar 3, a first bolt 4, an elastic or pressure element 5, a stripping bolt 6, a second bolt 7, a die-mounting bolt 8, a B-type pillar 9, a locating pin 10, a cylindrical guide column 11, a third bolt 60, an outer supporting frame 62, and a square guide column 201. The base 1 is provided orderly with a first hole 101, a second hole 102, a third screwed hole 103, a fourth hole 104, a fifth hole 105, a twelfth hole 61, and a hoisting screw hole 12. The pressing and stripping plate 2 is provided orderly with a guiding groove 301, a sixth hole 106, a seventh hole 107, an eighth hole 108, a ninth hole 109, and a tenth hole 110. The elastic or pressure element 5 is provided between the base 1 and the pressing and stripping plate 2 and is movably connected therebetween via the striping bolt 6. The stripping bolt 6 passes through the seventh hole 107 with an upper end thereof being connected and fixed in the third screwed hole 103 and the lower plug head being provided in the seventh hole 107, pre-presses the elastic or pressure element 5 via the stepped shape seventh hole 107, and restricts the downward movement area of the pressing and stripping plate 2. When in operation, the pressing and stripping plate 2 reciprocates pivotally along the stripping bolt 6. The first bolt 4, which passes through the second hole 102, is securely coupled with a central axial screwed hole of the A-type pillar 3. An upper end of the A-type pillar 3 is connected to the base 1 while a lower end thereof passes through the sixth hole 106. An upper end of the die-mounting bolt 8 is provided in the fourth hole 104 while a lower end thereof is provided in a central axial hole of the B-type pillar 9. A middle upper end portion thereof is provided with a block ring, and the whole body thereof is supported by a cylindrical steel wire compression spring provided in the central axial hole of the B-type pillar 9, wherein when the upper end thereof is under pressure, the whole body moves downward and is capable of rotating along the positive and negative directions with respect to its axis so as to install or detach the present invention with from a novel punch die. The B-type pillar 9 is connected and fixed on a bottom surface of the base 1 via the second bolt 7 while a lower end thereof is provided in the eighth hole 108. The A-type pillar 3 and the B-type pillar 9 are disposed in the base 1 and the pressing and stripping plate 2 form a grid shape. The cylindrical guide column 11 has a first end fixed and mounted in the fifth hole 105 of the base 1 via a bolt and the second end that passes through the tenth hole 110 of the pressing and stripping plate 2 so as to form a clearance fit with the pressing and stripping plate 2. The third bolt 50 passes through the twelfth hole 61 and firmly connects the outer supporting frame 62 with the base 1. The outer supporting frame 62, which is cuboid shaped, surrounds the pressing and stripping plate 2. The square guide column 201 has a first end fixed and mounted in the first hole 101 of the base 1 via a bolt and a pressing plate, and a second end that passes through the guide groove 301 at the lateral side of the pressing and stripping plate 2 so as to form a clearance fit with pressing and striping plate 2. The locating pin 10 is connected and fixed in the ninth hole 109. The base 1 is provided with the hoisting screw hole 12.

The A-type and B-type pillars of the present invention, which are mounted on the base 1 and form a grid shape, that pass through the pressing and stripping plate 2 and together with the outer supporting frame 62 which surrounds the pressing and stripping plate serves to provide a support between the novel punch die and an upper slide block or a lower operation platform of the punch press. Because the elastic or pressure element is limited for the amount of compression, the elastic and pressure element will cease to be in effect when the amount of compression is overtaken. Therefore, a function of stepped shoulders of the B-type pillar is limiting the compression of the elastic and pressure element 5 so as to prevent the elastic and pressure element 5 from losing effectiveness. A function of the locating pin 10 is to provide retaining effect when mounting the present invention on the novel punch die. A function of the cylindrical guide column 11 and the square guide column is to provide guiding and a balancing effect for the pressing and stripping plate 2 which moves back and forth when the present invention is in operation. The hoisting screw hole 12 is used to install a hosting instrument so that the present invention can be hoisted to the die. The die-mounting bolt 8 has a modular structure. When in a working state, it is used for firmly mounting the present invention on the die. When in a non-working state, it remains silent in the present invention.

The elastic or pressure element 5 of the present invention is selected from a group consisting of a metal spiral spring, a nitrogen spring, a pneumatic cylinder modular arrangement with a single piston rod, and hydraulic cylinder with a single piston rod.

Figure 2:
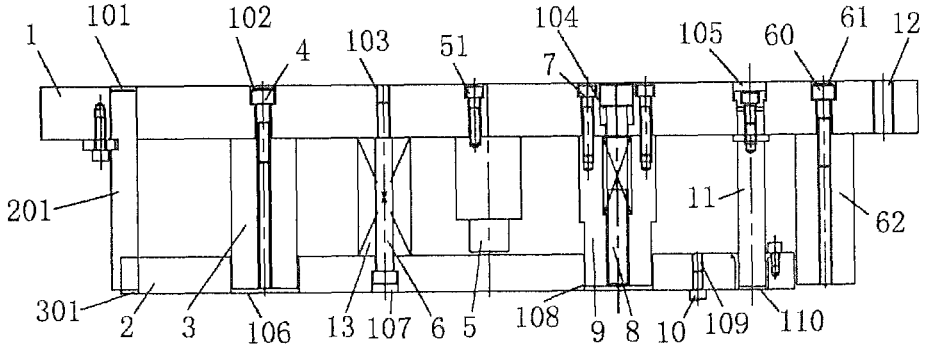
FIG. 2 is a schematic view of a first preferred embodiment of the present invention.

Referring to FIG. 2 of the drawings, a first preferred embodiment of the present invention comprises a base 1, a pressing and striping plate 2, an A-type pillar 3, a first bolt 4, an elastic or pressure element 5, a stripping bolt 6, a second bolt 7, a die-mounting bolt 8, a B-type pillar 9, a locating pin 10, a cylindrical guide column 11, a third bolt 60, an outer supporting frame 62, and a square guide column 201. The base 1 is provided orderly with a first hole 101, a second hole 102, a third screwed hole 103, a fourth hole 104, a fifth hole 105, a twelfth hole 61, and a hoisting screw hole 12. The pressing and stripping plate 2 is provided orderly with a guiding groove 301, a sixth hole 106, a seventh hole 107, an eighth hole 108, a ninth hole 109, and a tenth hole 110. The elastic or pressure element 5 is provided between the base 1 and the pressing and stripping plate 2 and is movably connected therebetween via the striping bolt 6. The stripping bolt 6 passes through the seventh hole 107 with an upper end thereof being connected and fixed in the third screwed hole 103 and a lower plug head being provided in the seventh hole 107, pre-presses the elastic or pressure element 5 via the stepped shape seventh hole 107, and restricts the downward movement area of the pressing and stripping plate 2. When in operation, the pressing and stripping plate 2 reciprocates pivotally along the stripping bolt 6. The first bolt 4, which passes through the second hole 102, is securely coupled with a central axial screwed hole of the A-type pillar 3. The upper end of the A-type pillar 3 is connected to the base 1 while the lower end thereof passes through the sixth hole 106. The upper end of the die-mounting bolt 8 is provided in the fourth hole 104 while The lower end thereof is provided in a central axial hole of the B-type pillar 9. The middle upper end portion thereof is provided with a block ring, and the whole body thereof is supported by a cylindrical steel wire compression spring provided in the central axial hole of the B-type pillar 9, wherein when the upper end thereof is under pressure the whole body moves downward and is capable of rotating along the positive and negative directions with respect to its axis so as to install or detach the present invention from a novel punch die. The B-type pillar 9 is connected and fixed on a bottom surface of the base 1 via the second bolt 7 while a lower end thereof is provided in the eighth hole 108. The A-type pillar 3 and the B-type pillar 9, disposed in the base 1 and the pressing and stripping plate 2, form a grid shape. The cylindrical guide column 11 has a first end fixed and mounted in the fifth hole 105 of the base 1 via a bolt and a second end that passes through the tenth hole 110 of the pressing and stripping plate 2 so as to form a clearance fit with the pressing and stripping plate 2. The third bolt 50 passes through the twelfth hole 61 and firmly connects the outer supporting frame 62 with the base 1. The outer supporting frame 62, which is cuboid shaped, surrounds the pressing and stripping plate 2. The square guide column 201 has a first end fixed and mounted in the first hole 101 of the base 1 via a bolt and a pressing plate, and a second end that passes through the guide groove 301 at the lateral side of the pressing and stripping plate 2 so as to form a clearance fit with pressing and striping plate 2. The locating pin 10 is connected and fixed in the ninth hole 109. The base 1 is provided with the hoisting screw hole 12. The elastic or pressure element 5 employs a nitrogen spring for the pressing and stripping apparatus of a punch die. The nitrogen spring is provided between the base 1 and the pressing and stripping plate 2, and is secured on the base 1 via the third bolt 51 or by mounting a flange. In order to prolong the life span of the nitrogen spring, the stripping bolt 6 is provided with a spring 13 to jack-up the pressing and stripping plate 2 in the non-working state, so as to prevent a lower end of the nitrogen spring from coming into contact with the pressing and stripping plate 2. When the present invention is firmly mounted on the die via the die-mounting bolt 8, the pressing and stripping plate is pressed to have contact with the nitrogen spring so as to pre-press the nitrogen spring.

Figure 3:
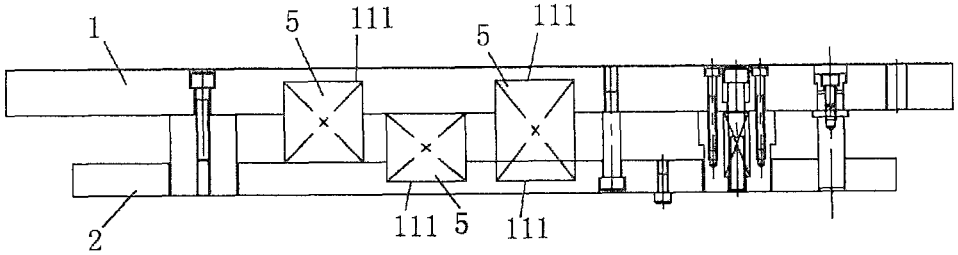
FIG. 3 is a schematic view of a second preferred embodiment of the present invention.

As shown in FIG. 3 of the drawings, a second preferred embodiment is modified based on the first preferred embodiment. There are blind holes 111 provided in an opposite facing surface of the base 1 or the pressing and stripping plate 2. The elastic or pressure element 5 has a first end provided in the blind hole 111, and a second end having contact with the surface of the pressing and stripping plate 2 or the base 1. The blind holes 111 can be provided in both opposite facing surfaces of the base 1 and the pressing and stripping plate 2. The two ends of the elastic or pressure element 5 are respectively provided in the blind holes 111.

Figure 4:
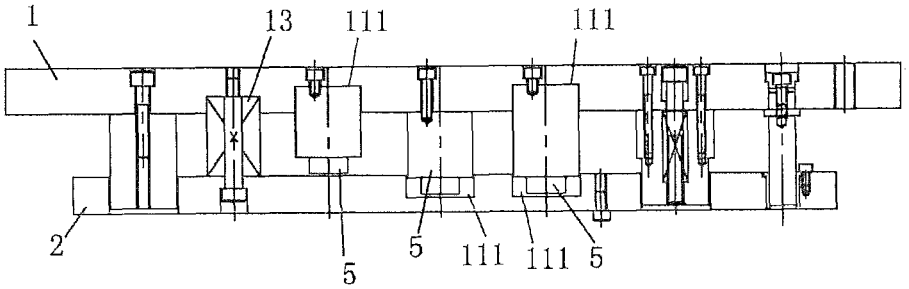
FIG. 4 is a schematic view of a third preferred embodiment of the present invention.

As shown in FIG. 4 of the drawings, a third preferred embodiment is based on the first preferred embodiment. The elastic or pressure element 5 is a nitrogen spring. There are blind holes 111 provided in an opposite facing surface of the base 1 or the pressing and stripping plate 2. The elastic or pressure element 5 has a first end provided in the blind hole 111, and a second end having contact with the surface of the pressing and stripping plate 2 or the base 1. The blind holes 111 can be provided in both opposite facing surfaces of the base 1 and the pressing and stripping plate 2. The two ends of the elastic or pressure element 5 are respectively provided in the blind holes 111.

The object of the second and third preferred embodiment is to reduce the height of the pressing and stripping apparatus for the punch die.

Figure 5:
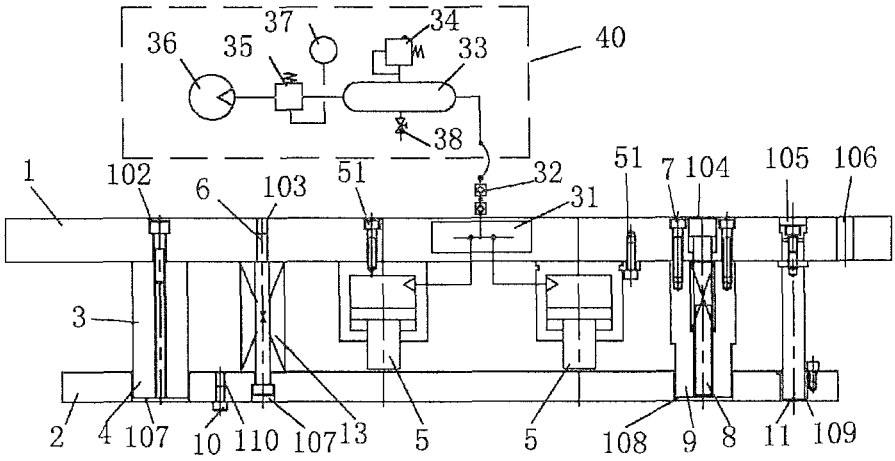
FIG. 5 is a schematic view of a fourth preferred embodiment of the present invention.

Referring to FIG. 5 of the drawings, a fourth preferred embodiment of the present invention comprises a base 1, a pressing and striping plate 2, an A-type pillar 3, a first bolt 4, an elastic or pressure element 5, a stripping bolt 6, a second bolt 7, a die-mounting bolt 8, a B-type pillar 9, a locating pin 10, a cylindrical guide column 11, a third bolt 60, an outer supporting frame 62, and a square guide column 201. The base 1 is provided orderly with a first hole 101, a second hole 102, a third screwed hole 103, a fourth hole 104, a fifth hole 105, a twelfth hole 61, and a hoisting screw hole 12. The pressing and stripping plate 2 is provided orderly with a guiding groove 301, a sixth hole 106, a seventh hole 107, an eighth hole 108, a ninth hole 109, and a tenth hole 110. The elastic or pressure element 5 is provided between the base 1 and the pressing and stripping plate 2, and is movably connected therebetween via the striping bolt 6. The stripping bolt 6 passes through the seventh hole 107 with an upper end thereof being connected and fixed in the third screwed hole 103 and a lower plug head being provided in the seventh hole 107, pre-presses the elastic or pressure element 5 via the stepped shape seventh hole 107, and restricts the downward movement area of the pressing and stripping plate 2. When in operation, the pressing and stripping plate 2 reciprocates pivotally along the stripping bolt 6. The first bolt 4 which passes through the second hole 102 is securely coupled with a central axial screwed hole of the A-type pillar 3. An upper end of the A-type pillar 3 is connected to the base 1, while a lower end thereof passes through the sixth hole 106. An upper end of the die-mounting bolt 8 is provided in the fourth hole 104, while a lower end thereof is provided in a central axial hole of the B-type pillar 9 and a middle upper end portion thereof is provided with a block ring, and a whole body thereof is supported by a cylindrical steel wire compression spring provided in the central axial hole of the B-type pillar 9, wherein when the upper end thereof is under pressure the whole body moves downward and is capable of rotating along the positive and negative directions with respect to its axis; so as to install or detach the present invention from a novel punch die. The B-type pillar 9 is connected and fixed on a bottom surface of the base 1 via the second bolt 7, while a lower end thereof is provided in the eighth hole 108. The A-type pillar 3 and the B-type pillar 9 are disposed in the base 1, and the pressing and stripping plate 2 form a grid shape. The cylindrical guide column 11 has a first end fixed and mounted in the fifth hole 105 of the base 1 via a bolt, and a second end that passes through the tenth hole 110 of the pressing and stripping plate 2 so as to form a clearance fit with the pressing and stripping plate 2. The third bolt 50 passing through the twelfth hole 61 firmly connect the outer supporting frame 62 with the base 1. The outer supporting frame 62, which is cuboid shaped, surrounds the pressing and stripping plate 2. The square guide column 201 has a first end fixed and mounted in the first hole 101 of the base 1 via a bolt and a pressing plate, and a second end that passes through the guide groove 301 at the lateral side of the pressing and stripping plate 2 so as to form a clearance fit with pressing and striping plate 2. The locating pin 10 is connected and fixed in the ninth hole 109. The base 1 is provided with the hoisting screw hole 12. The elastic or pressure element 5 is constructed to have a pneumatic cylinder module 5 with a single piston rod and an external pressure adjusting system 40. The pneumatic cylinder module 5 with a single piston rod is firmly connected to the base 1 via the third bolt 51. The base 1 is provided with pipe module 31. The pneumatic cylinder module 5 with a single piston rod is connected to the pipe module 31. The pipe module 31 is connected to a quick-change adapter 32 of the external pressure adjusting system 40. The adjusting system 40 comprises the quick-change adapter 32, a gas storing jar 33, a safety valve 34, a first pressure adjusting valve 35, a gas pump 36, a first counting meter 37, and a valve 38. The quick-change adapter 32 is connected to the gas storing jar 33. The gas storing jar 33 is respectively connected to the safety valve 34 and the valve 38. The gas storing jar 33 is connected to the first pressure adjusting valve 35. The first pressure adjusting valve 35 is connected to the gas pump 36. The first pressure adjusting valve 3 is connected to the first counting meter 37. In order to increase the life span of the pneumatic cylinder module 5 with a single piston rod, the stripping bolt 6 is provided with a spring 13 to jack-up the pressing and stripping plate 2 in the non-working state, so as to prevent a lower end of the nitrogen spring from contacting with the pressing and stripping plate 2. When the present invention is firmly mounted on the die via the die-mounting bolt 8, the pressing and stripping plate is pressed to have contact with the nitrogen spring so as to pre-press the nitrogen spring.

The operating principle of the fourth preferred embodiment is illustrated in the following description:

1. Adjust the pressure of the pressure adjusting valve 35 of the external pressure adjusting system 40 according to practical requirements to control the pressure of the pneumatic cylinder module 5 with a single piston rod.

2. When the slide block of the punch press moves downward with a working route, the pressing force produced from the closing of the die forces the pressing and stripping plate 2 to move upward, and the piston of the pneumatic cylinder module 5 with a single piston rod compresses the compressed air therein back into the gas storing jar through the pipe module 31 and the quick-change adapter 32.

3. When the slide block of the punch press moves back with a working route, the compressed air in the gas storing jar 33 is compressed into the pneumatic cylinder module 5 with a single piston rod through the pipe module 31 and the quick-change adapter 32 so as to push the piston rod to drive the pressing and stripping plate 2 to move downward and produce a stripping force by the die.

Figure 6:
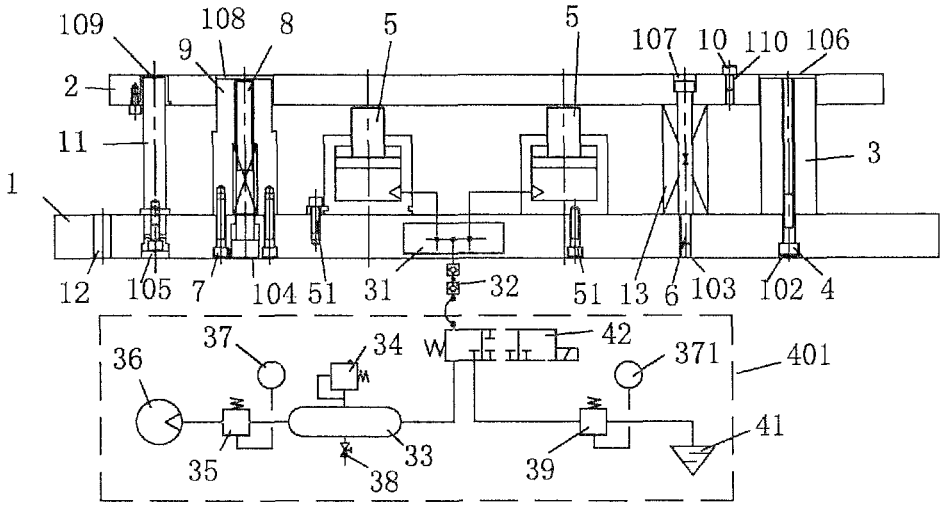
FIG. 6 is a schematic view of a fifth preferred embodiment of the present invention.

Referring to FIG. 6 of the drawings, a fifth preferred embodiment of the present invention comprises a base 1, a pressing and striping plate 2, an A-type pillar 3, a first bolt 4, an elastic or pressure element 5, a stripping bolt 6, a second bolt 7, a die-mounting bolt 8, a B-type pillar 9, a locating pin 10, a cylindrical guide column 11, a third bolt 60, an outer supporting frame 62, and a square guide column 201. The base 1 is provided orderly with a first hole 101, a second hole 102, a third screwed hole 103, a fourth hole 104, a fifth hole 105, a twelfth hole 61, and a hoisting screw hole 12. The pressing and stripping plate 2 is provided orderly with a guiding groove 301, a sixth hole 106, a seventh hole 107, an eighth hole 108, a ninth hole 109, and a tenth hole 110. The elastic or pressure element 5 is provided between the base 1 and the pressing and stripping plate 2, and is movably connected therebetween via the striping bolt 6. The stripping bolt 6 passes through the seventh hole 107 with an upper end thereof being connected and fixed in the third screwed hole 103 and a lower plug head being provided in the seventh hole 107, pre-presses the elastic or pressure element 5 via the stepped shape seventh hole 107, and restricts the downward movement area of the pressing and stripping plate 2. When in operation, the pressing and stripping plate 2 reciprocates pivotally along the stripping bolt 6. The first bolt 4, which passes through the second hole 102, is securely coupled with a central axial screwed hole of the A-type pillar 3. An upper end of the A-type pillar 3 is connected to the base 1 while a lower end thereof passes through the sixth hole 106. An upper end of the die-mounting bolt 8 is provided in the fourth hole 104, while a lower end thereof is provided in a central axial hole of the B-type pillar 9. A middle upper end portion thereof is provided with a block ring, and the whole body thereof is supported by a cylindrical steel wire compression spring provided in the central axial hole of the B-type pillar 9, wherein when the upper end thereof is under pressure the whole body moves downward and is capable of rotating along the positive and negative directions with respect to its axis, so as to install or detach the present invention from a novel punch die. The B-type pillar 9 is connected and fixed on a bottom surface of the base 1 via the second bolt 7 while a lower end thereof is provided in the eighth hole 108. The A-type pillar 3 and the B-type pillar 9 are disposed in the base 1, and the pressing and stripping plate 2 form a grid shape. The cylindrical guide column 11 has a first end fixed and mounted in the fifth hole 105 of the base 1 via a bolt, and a second end that passes through the tenth hole 110 of the pressing and stripping plate 2 so as to form a clearance fit with the pressing and stripping plate 2. The third bolt 50 passing through the twelfth hole 61 firmly connects the outer supporting frame 62 with the base 1. The outer supporting frame 62, which is cuboid shaped, surrounds the pressing and stripping plate 2. The square guide column 201 has a first end fixed and mounted in the first hole 101 of the base 1 via a bolt and a pressing plate, and a second end that passes through the guide groove 301 at the lateral side of the pressing and stripping plate 2 so as to form a clearance fit with pressing and striping plate 2. The locating pin 10 is connected and fixed in the ninth hole 109. The base 1 is provided with the hoisting screw hole 12. The elastic or pressure element 5 is constructed to comprise a pneumatic cylinder module 5 with a single piston rod and an external pressure adjusting system 401. The pneumatic cylinder module 5 with a single piston rod is firmly connected to the base 1 via the third bolt 51. The base 1 is provided with pipe module 31. The pneumatic cylinder module 5 with a single piston rod is connected to the pipe module 31. The pipe module 31 is connected to a quick-change adapter 32 of the external pressure adjusting system 401. The external pressure adjusting system 401 comprises the quick-change adapter 32, a two position three way directional control valve 42, a gas storing jar 33, a safety valve 34, a first pressure adjusting valve 35, a second pressure adjusting valve 39, a gas pump 36, a first counting meter 37, a second counting member 371, and a noise damping and gas discharging device 41. The two-position three-way directional control valve 42 is respectively connected to the quick-change adapter 32 and the gas storing jar 33, and is connected to the noise damping and gas discharging device 41 through the second pressure adjusting valve 39. The gas storing jar 33 is respectively connected to the safety valve 34 and the valve 38, and is connected to the gas pump 36 through the first pressure adjusting valve 35. The first pressure adjusting valve 35 is connected to the first counting meter 37. The second counting meter 371 is connected to the second pressure adjusting valve 39. In order to increase the life span of the pneumatic cylinder module 5 with a single piston rod, the stripping bolt 6 is provided with a spring 13 to jack-up the pressing and stripping plate 2 in the non-working state, so as to prevent a lower end of the nitrogen spring from contacting with the pressing and stripping plate 2. When the present invention is firmly mounted on the die via the die-mounting bolt 8, the pressing and stripping plate is pressed to have contact with the nitrogen spring so as to pre-press the nitrogen spring.

The operating principle of the fifth preferred embodiment is illustrated in the following description.

1. Adjust the pressure of the first and second pressure adjusting valve 38 and 39 of the external pressure adjusting system 401 respectively according to practical requirements, so as to control the initial pressure and working pressure of the pneumatic cylinder module 5 with a single piston rod through controlling the gas intake and gas discharge pressure.

2. When the slide block of the punch press is located at an "upper dead position", the two-position three-way directional control valve 42 operates to control the opening of the gas intake valve and closing of the gas discharge valve.

3. When the slide block of the punch press moves downward with a working route, the two-position three-way directional control valve 42 operates to control the closing of the gas intake valve and opening of the gas discharge valve. The pressing force produced from closing of the die forces the pressing and stripping plate 2 to move upward, and the piston of the pneumatic cylinder module 5 with a single piston rod compresses the compressed air therein into a discharging pipe through the pipe module and the two-position three-way directional control valve 42. The second pressure adjusting valve 39 is used to control the pressure. The excess compressed air is discharged into the air through the noise damping and gas discharging device 41.

4. When the slide block of the punch press is located at a "lower dead position", the die is completely closed, and the two-position three-way directional control valve 42 operates to control the closing of the gas intake valve and opening of the gas discharge valve.

5. When the slide block of the punch press moves back with a working route the die gradually departs, the two-position three-way directional control valve 42 operates to control the closing of the gas intake valve and opening of the gas discharge valve. Since there is no compressed air compressing into the pneumatic cylinder module 5 with a single piston rod, the pressing and striping plate 2 retains the die in the closing state.

6. When the slide block of the punch press moves back to the "upper dead position", the two-position three-way directional control valve 42 operates to control the opening of the gas intake valve and closing of the gas discharge valve. The compressed air in the air intake pipe is compressed into the pneumatic cylinder module 5 with a single piston rod through the two-position three-way directional control valve 42 so as to push the piston rod to drive the pressing and stripping plate 2 to move downward and to produce a stripping force by the die.

Figure 7:
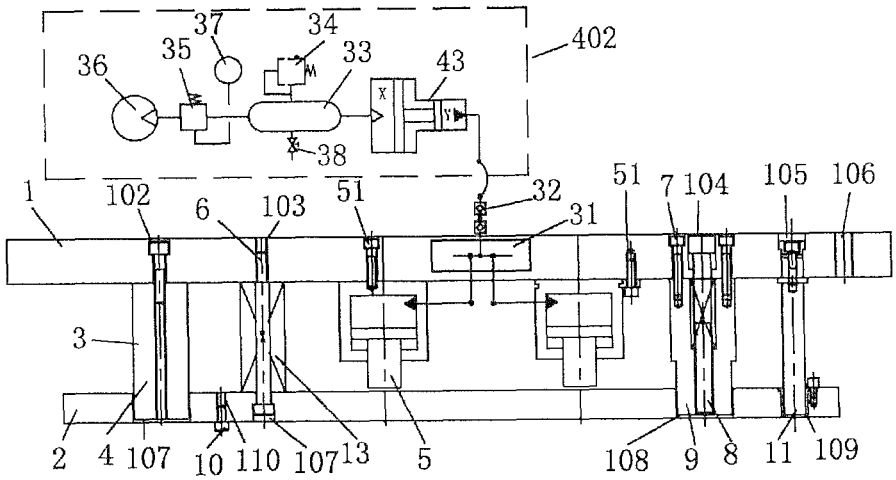
FIG. 7 is a schematic view of a sixth preferred embodiment of the present invention.

Referring to FIG. 7 of the drawings, a sixth preferred embodiment of the present invention comprises a base 1, a pressing and striping plate 2, an A-type pillar 3, a first bolt 4, an elastic or pressure element 5, a stripping bolt 6, a second bolt 7, a die-mounting bolt 8, a B-type pillar 9, a locating pin 10, a cylindrical guide column 11, a third bolt 60, an outer supporting frame 62, and a square guide column 201. The base 1 is provided orderly with a first hole 101, a second hole 102, a third screwed hole 103, a fourth hole 104, a fifth hole 105, a twelfth hole 61, and a hoisting screw hole 12. The pressing and stripping plate 2 is provided orderly with a guiding groove 301, a sixth hole 106, a seventh hole 107, an eighth hole 108, a ninth hole 109, and a tenth hole 110. The elastic or pressure element 5 is provided between the base 1 and the pressing and stripping plate 2, and is movably connected therebetween via the striping bolt 6. The stripping bolt 6 passes through the seventh hole 107 with an upper end thereof being connected and fixed in the third screwed hole 103 and a lower plug head being provided in the seventh hole 107, pre-presses the elastic or pressure element 5 via the stepped shape seventh hole 107, and restricts the downward movement area of the pressing and stripping plate 2. When in operation, the pressing and stripping plate 2 reciprocates pivotally along the stripping bolt 6. The first bolt 4 which passes through the second hole 102 is securely coupled with a central axial screwed hole of the A-type pillar 3. An upper end of the A-type pillar 3 is connected to the base 1 while a lower end thereof passes through the sixth hole 106. An upper end of the die-mounting bolt 8 is provided in the fourth hole 104 while a lower end thereof is provided in a central axial hole of the B-type pillar 9. A middle upper end portion thereof is provided with a block ring, and the whole body thereof is supported by a cylindrical steel wire compression spring provided in the central axial hole of the B-type pillar 9, wherein when the upper end thereof is under pressure the whole body moves downward and is capable of rotating along the positive and negative directions with respect to its axis, so as to install or detach the present invention with from a novel punch die. The B-type pillar 9 is connected and fixed on a bottom surface of the base 1 via the second bolt 7 while a lower end thereof is provided in the eighth hole 108. The A-type pillar 3 and the B-type pillar 9 are disposed in the base 1 and the pressing and stripping plate 2 forms a grid shape. The cylindrical guide column 11 has a first end fixed and mounted in the fifth hole 105 of the base 1 via a bolt, and a second end that passes through the tenth hole 110 of the pressing and stripping plate 2 so as to form a clearance fit with the pressing and stripping plate 2. The third bolt 50 passing through the twelfth hole 61 firmly connects the outer supporting frame 62 with the base 1. The outer supporting frame 62, which is cuboid shaped, surrounds the pressing and stripping plate 2. The square guide column 201 has a first end fixed and mounted in the first hole 101 of the base 1 via a bolt and a pressing plate, and a second end that passes through the guide groove 301 at the lateral side of the pressing and stripping plate 2 so as to form a clearance fit with pressing and striping plate 2. The locating pin 10 is connected and fixed in the ninth hole 109. The base 1 is provided with the hoisting screw hole 12. The elastic or pressure element 5 is constructed to have a pneumatic cylinder module 5 with a single piston rod and an external pressure adjusting system 402. The pneumatic cylinder module 5 with a single piston rod is firmly connected to the base 1 via the third bolt 51. The base 1 is provided with pipe module 31. The pneumatic cylinder module 5 with a single piston rod is connected to the pipe module 31. The pipe module 31 is connected to a quick-change adapter 32 of the external pressure adjusting system 402. The external pressure adjusting system comprises a quick-change adapter 32, a booster 43, a gas storing jar 33, a safety valve 34, a valve 38, a first pressure adjusting valve 35, a first counting meter 37, and a gas pump 36. The booster 43 is connected with the quick-change adapter 32 and the gas storing jar 33. The gas storing jar 33 is respectively connected to safety valve 34 and the valve 38, and is connected to the gas pump through the first pressure adjusting valve 35. The first counting meter 37 is connected to the first pressure adjusting valve 35. In order to increase the life span of the pneumatic cylinder module 5 with a single piston rod, the stripping bolt 6 is provided with a spring 13 to jack-up the pressing and stripping plate 2 in the non-working state, so as to prevent a lower end of the nitrogen spring from coming into contact with the pressing and stripping plate 2. When the present invention is firmly mounted on the die via the die-mounting bolt 8, the pressing and stripping plate is pressed into contact with the nitrogen spring so as to pre-press the nitrogen spring.

The operating principle of the sixth preferred embodiment is illustrated in the following description.

1. Adjust the pressure of the pressure adjusting valve 35 of the external pressure adjusting system 40 according to practical requirements, and control the pressure of the pneumatic cylinder module 5 with a single piston rod through the booster 43.

2. When the slide block of the punch press moves downward with a working route, the pressing force produced from closing of the die forces the pressing and stripping plate 2 to move upward, and the piston of the pneumatic cylinder module 5 with a single piston rod compresses the hydraulic oil therein into the booster 43 through the pipe module 31 and the quick-change adapter 32, so as to push a piston of the booster 43 to compress the compressed air back into the gas storing jar 33.

3. When the slide block of the punch press moves back with a working route, the compressed air in the gas storing jar 33 pushes the piston of the booster 5 so as to compress the hydraulic oil into the pneumatic cylinder module 5 with a single piston rod through the pipe module 31 and the quick-change adapter 32 in order to push the piston rod to drive the pressing and stripping plate 2 to move downward as well as to produce a stripping force by the die.

Figure 8:
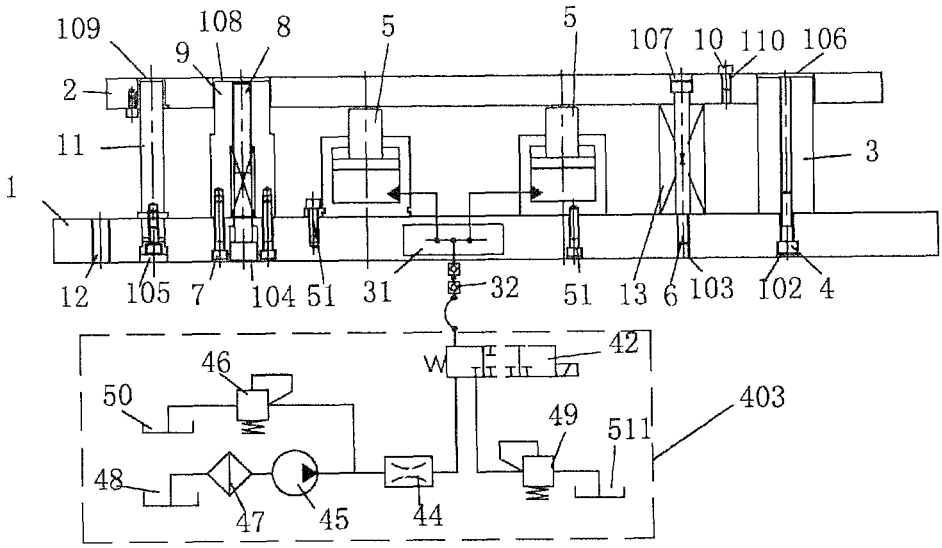
FIG. 8 is a schematic view of a seventh preferred embodiment of the present invention.

Referring to FIG. 8 of the drawings, a seventh preferred embodiment of the present invention comprises a base 1, a pressing and striping plate 2, an A-type pillar 3, a first bolt 4, an elastic or pressure element 5, a stripping bolt 6, a second bolt 7, a die-mounting bolt 8, a B-type pillar 9, a locating pin 10, a cylindrical guide column 11, a third bolt 60, an outer supporting frame 62, and a square guide column 201. The base 1 is provided orderly with a first hole 101, a second hole 102, a third screwed hole 103, a fourth hole 104, a fifth hole 105, a twelfth hole 61, and a hoisting screw hole 12. The pressing and stripping plate 2 is provided orderly with a guiding groove 301, a sixth hole 106, a seventh hole 107, an eighth hole 108, a ninth hole 109, and a tenth hole 110. The elastic or pressure element 5 is provided between the base 1 and the pressing and stripping plate 2 and is movably connected therebetween via the striping bolt 6. The stripping bolt 6 passes through the seventh hole 107 with an upper end thereof being connected and fixed in the third screwed hole 103 and a lower plug head being provided in the seventh hole 107, pre-presses the elastic or pressure element 5 via the stepped shape seventh hole 107, and restricts the downward movement area of the pressing and stripping plate 2. When in operation, the pressing and stripping plate 2 reciprocates pivotally along the stripping bolt 6. The first bolt 4, which passes through the second hole 102, is securely coupled with a central axial screwed hole of the A-type pillar 3. An upper end of the A-type pillar 3 is connected to the base 1, while a lower end thereof passes through the sixth hole 106. An upper end of the die-mounting bolt 8 is provided in the fourth hole 104, while a lower end thereof is provided in a central axial hole of the B-type pillar 9. A middle upper end portion thereof is provided with a block ring, and the whole body thereof is supported by a cylindrical steel wire compression spring provided in the central axial hole of the B-type pillar 9, wherein when the upper end thereof is under pressure the whole body moves downward and is capable of rotating along the positive and negative directions with respect to its axis, so as to install or detach the present invention from a novel punch die. The B-type pillar 9 is connected and fixed on a bottom surface of the base 1 via the second bolt 7, while a lower end thereof is provided in the eighth hole 108. The A-type pillar 3 and the B-type pillar 9 are disposed in the base 1, and the pressing and stripping plate 2 forms a grid shape. The cylindrical guide column 11 has a first end fixed and mounted in the fifth hole 105 of the base 1 via a bolt, and a second end that passes through the tenth hole 110 of the pressing and stripping plate 2 so as to form a clearance fit with the pressing and stripping plate 2. The third bolt 50 passing through the twelfth hole 61 firmly connects the outer supporting frame 62 with the base 1. The outer supporting frame 62, which is cuboid shaped, surrounds the pressing and stripping plate 2. The square guide column 201 has a first end fixed and mounted in the first hole 101 of the base 1 via a bolt and a pressing plate, and a second end that passes through the guide groove 301 at the lateral side of the pressing and stripping plate 2 so as to form a clearance fit with pressing and striping plate 2. The locating pin 10 is connected and fixed in the ninth hole 109. The base 1 is provided with the hoisting screw hole 12. The elastic or pressure element 5 is constructed to have a pneumatic cylinder module 5 with a single piston rod and an external pressure adjusting system 403. The pneumatic cylinder module 5 with a single piston rod is firmly connected to the base 1 via the third bolt 51. The base 1 is provided with pipe module 31. The pneumatic cylinder module 5 with a single piston rod is connected to the pipe module 31. The pipe module 31 is connected to a quick-change adapter 32 of the external pressure adjusting system 403. The external pressure adjusting system 403 comprises a quick-change adapter 32, a two-position three-way directional control valve 42, a throttling valve 44, a first spillover valve 46, a second spillover valve 49, a hydraulic pump 45, a filter 47, a first oil tank 48, a second oil tank 50, and a third oil tank 511. The two-position three-way directional control valve 42 is respectively connected to the quick-change adapter 32 and the throttling valve 44, and is connected to the third oil tank 511 through the second spillover valve 49. The throttling valve 44 is connected to the second oil tank 50 through the first spillover valve 46, and is connected to the filter 47 through the hydraulic pump 45. The filter 47 is connected to the first oil tank 48.

The operating principle of the seventh preferred embodiment is illustrated in the following description.

1. Adjust the pressure of the first and second spillover valve 46 and 49 of the external pressure adjusting system 403 respectively according to practical requirements, so as to control the initial pressure and working pressure of the pneumatic cylinder module 5 with a single piston rod through controlling the oil intake and oil discharge pressure.

2. When the slide block of the punch press is located at an "upper dead position", the two-position three-way directional control valve 42 operates to control the opening of the oil intake valve and closing of the oil discharge valve.

3. When the slide block of the punch press moves downward with a working route, the two-position three-way directional control valve 42 operates to control the closing of the oil intake valve and opening of the oil discharge valve. The pressing force produced from closing of the die forces the pressing and stripping plate 2 to move upward, and the piston of the pneumatic cylinder module 5 with a single piston rod compresses the hydraulic oil into an oil discharging pipe through the pipe module 31 and the two-position three-way directional control valve 42. In case of exceeding the predetermined working pressure, the hydraulic oil flows into the third oil tank 511 through the second spillover valve 49.

4. When the slide block of the punch press is located at a "lower dead position", the die is completely closed, and the two-position three-way directional control valve 42 operates to control the closing of the oil intake valve and opening of the oil discharge valve.

5. When the slide block of the punch press moves back with a working route the die gradually departs, the two-position three-way directional control valve 42 operates to control the closing of the oil intake valve and opening of the oil discharge valve. Since there is no hydraulic oil compressing into the pneumatic cylinder module 5 with a single piston rod, the pressing and striping plate 2 retains the die in the closing state.

6. When the slide block of the punch press moves back to the "upper dead position", the two-position three-way directional control valve 42 operates to control the opening of the oil intake valve and closing of the oil discharge valve. The hydraulic oil in the oil intake pipe is compressed into the pneumatic cylinder module 5 with a single piston rod through the two-position three-way directional control valve 42 so as to push the piston rod to drive the pressing and stripping plate 2 to move downward and to produce a stripping force by the die.

Figures 1, 9:
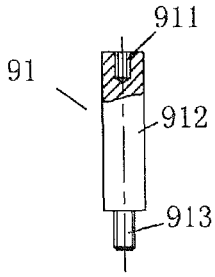
Figures 2, 9:
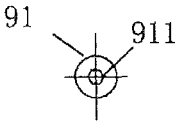
Figure 15:
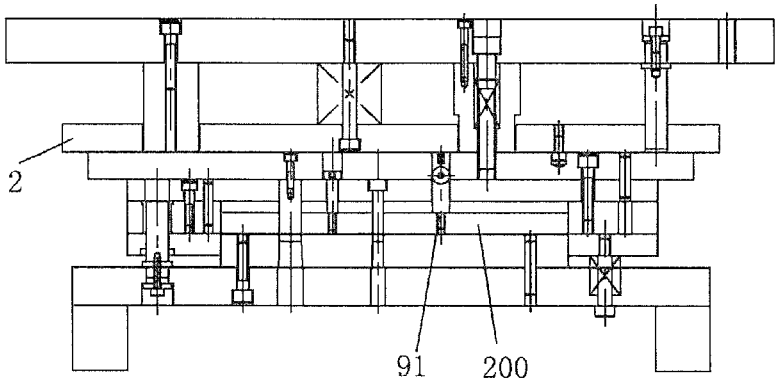
FIG. 15 is a schematic view illustrating the connection for the present invention being installed on an upper die of a novel punch die.

Referring to FIG. 9-1 and FIG. 9-2 of the drawings, the push rod 91 of the present invention has a polygonal blind hole 911 in an upper end thereof, and comprises parallel threads on a lower end of the column body 912. An end thereof is mounted on a pressing and stripping plate 200 in the die through the threads, and the other end thereof serves to act on the pressing and stripping plate 2 of the present invention in order to transfer the effect of the stripping force. An installation manner thereof is illustrated in FIG. 15 of the drawings.

Figures 1, 10:
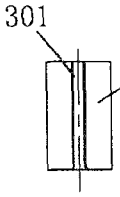
Figures 2, 10:
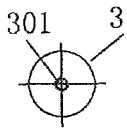
Figures 3, 10:
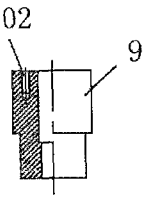
Figures 4, 10:
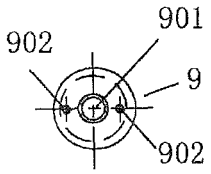

Referring to FIG. 10-1 and FIG. 10-2 of the drawings, the A-type pillar 3 of the present invention is of column structure. The A-type pillar 3 is provided with a first screwed hole 301. The A-type pillar 3 is firmly connected to the base 1 via a first bolt 4 through the first screwed hole 301.

Referring to FIG. 10-3 and FIG. 10-4 of the drawings, the B-type pillar 9 of the present invention is a column stepped structure. The B-type pillar 9 is provided with a stepped through hole 901 at the central axial thereof. One end of the stepped through hole 901 is provided with a second screwed hole 902. The B-type pillar 9 is in a screw connection with the second bolt 7 via the second screwed hole 902. The die-mounting bolt 8 penetrates into the stepped through hole 901.

Figure 11:
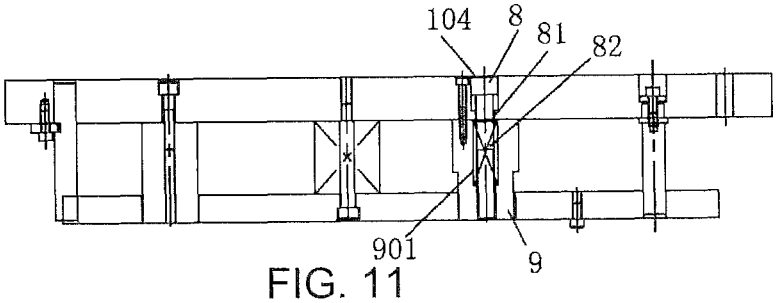
FIG. 11 is a schematic view of a first type of die-mounting bolt of the present invention.

FIG. 11 is a schematic view of a first die-mounting bolt 8 of the present invention. An upper half of the die-mounting bolt 8 is provided with a ring shaped groove. When in use, the die-mounting bolt 8 is passed through the hole 104 and a resilient block ring 81 is retained in the ring shaped groove of the die-mounting bolt 8. A lower half part of the die-mounting bolt 8 is provided with a column steel spring 82. The column steel spring 82 is installed in the stepped through hole 901 of the B-type pillar 9.

Figure 12:
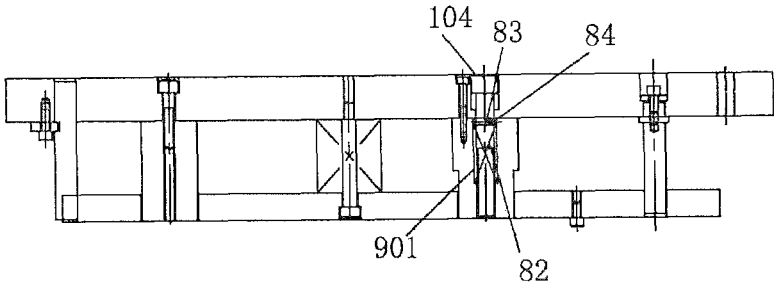
FIG. 12 is a schematic view of a second type of die-mounting bolt of the present invention.

FIG. 12 is a schematic view of a second die-mounting bolt 8 of the present invention. An upper half part of the die-mounting bolt 8 is provided with a blind hole. When in use, the die-mounting bolt 8 is passed through the hole 104, and a bolt 84 without a head is screwed into the blind hole via the screwed hole in the block ring 83; and then the block ring 83 is secured on the die-mounting bolt 8. A lower half part of the die-mounting bolt 8 is provided with a column steel spring 82. The column steel spring 82 is installed in the stepped through hole 901 of the B-type pillar 9.

Figure 13:
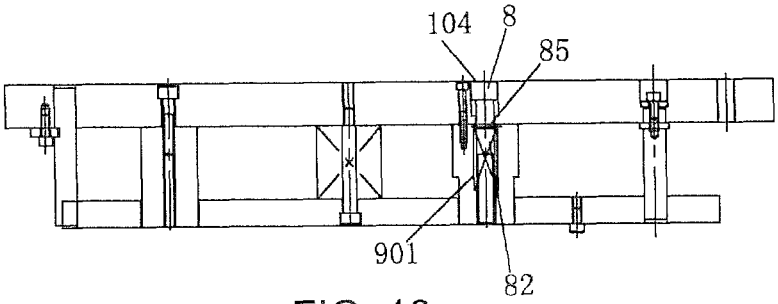
FIG. 13 is a schematic view of a third type of die-mounting bolt of the present invention.

FIG. 13 is a schematic view of a third die-mounting bolt 8 of the present invention. An upper half part of the die-mounting bolt 8 is provided with a radial hole. When in use, the die-mounting bolt 8 is passed through the hole 104, and then a resilient coiled pin 85 is passed through the radial hole. A lower half part of the die-mounting bolt 8 is provided with a column steel spring 82. The column steel spring 82 is installed in the stepped through hole 901 of the B-type pillar 9.

Figures 1, 14:
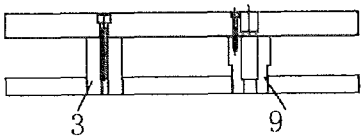
Figures 2, 14:
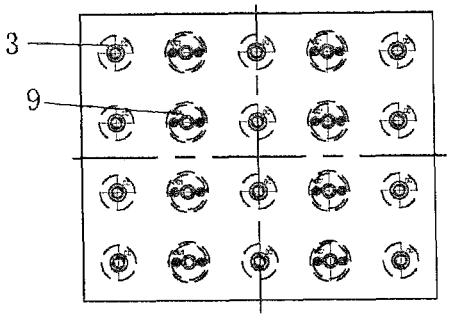

Referring to FIG. 14-1 and FIG. 14-2 of the drawings, a grid shaped configuration of the A-type and B-type pillars is illustrated. A characteristic of this structure is that one end thereof is mounted on the base 1 while the other end thereof is passed through a corresponding hole of the pressing and stripping plate 2 with the configuration thereof provides a grid shaped distribution.

Figure 16:
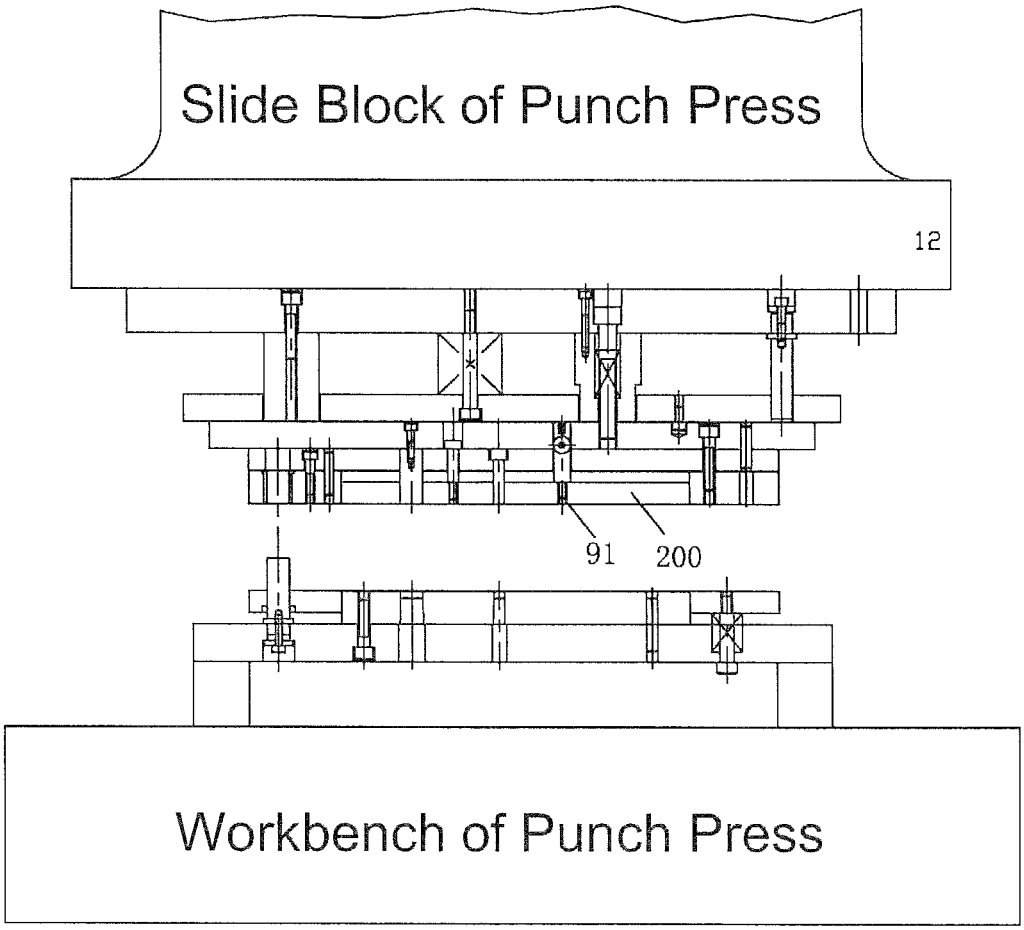
FIG. 16 is a schematic view illustrating the die in a open state at an upper limit position of the punch press of the present invention.

FIGS. 15 and 16 illustrates the pressing and stripping apparatus for a punch die being firmly mounted on the upper die via the die-mounting bolt 8 and forming an integral piece with the novel punch die so as to install with the punch press.

There is no pressing and stripping function in the novel punch die. The die pressing and stripping plate 200 of the upper die, of the die and the pressing and stripping plate 2 of the present invention, transfers pressing and stripping forces therebetween through the push rod 91.

Figure 17:
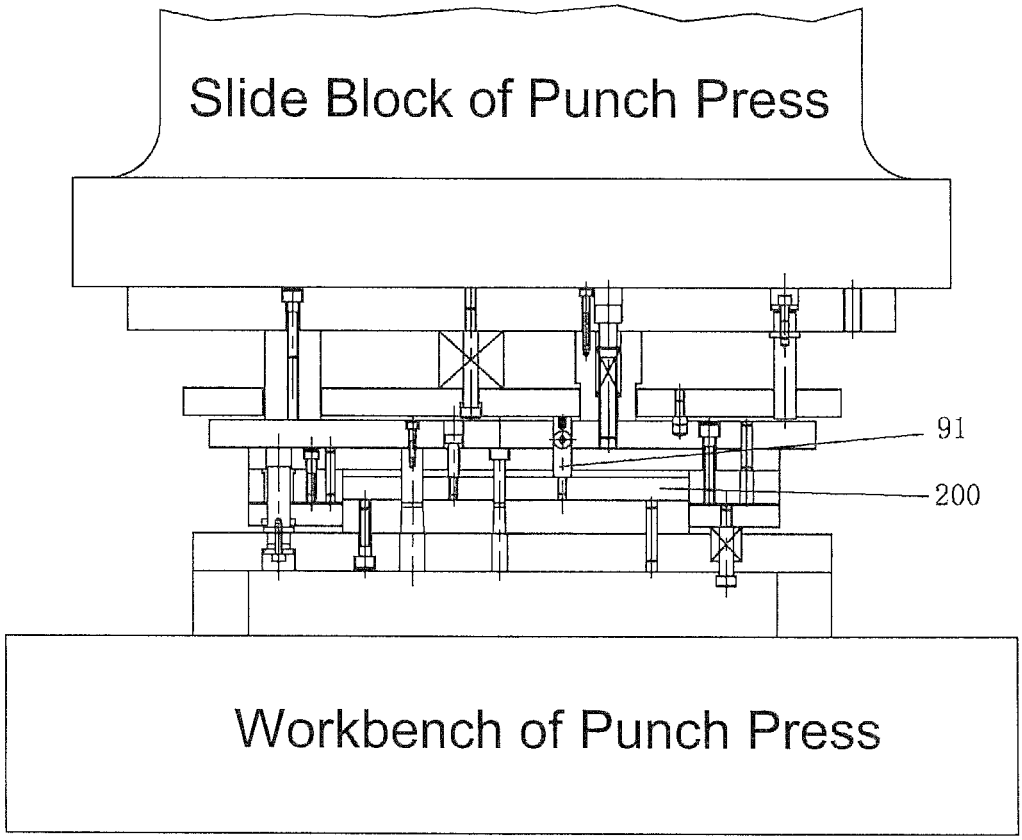
FIG. 17 is a schematic view illustrating the die in a closed state at a lower limit position of the punch press of the present invention.

FIG. 17 is a schematic view illustrating the die in a closed state at a lower limit position of the punch press of the present invention.

Figure 18:
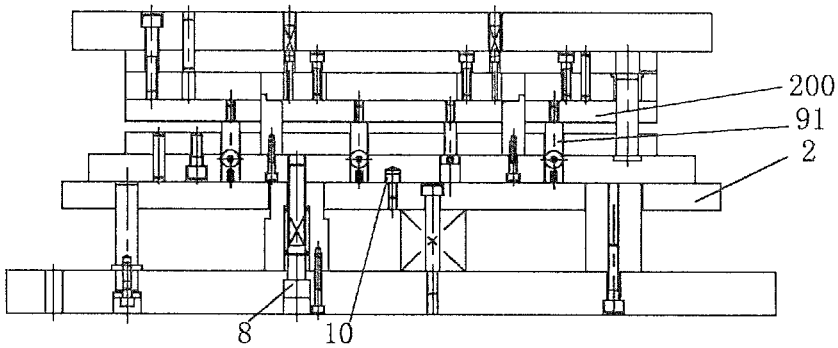
FIG. 18 is a schematic view illustrating the connection for the present invention being installed on a lower die of a novel bending die.

FIG. 18 is a schematic view illustrating the present invention being firmly mounted on a lower die of a novel bending die. The present invention of a novel bending die designed by the present invention is inverted and installed via the locating pin 10 and the die-mounting bolt 8 so as to form a one piece structure before installing on the punch press. The die pressing and stripping plate 200 of the lower die of the novel bending die and the pressing and stripping plate 2 of the present invention transfers pressing and stripping forces therebetween through the push rod 91.

Figure 19:
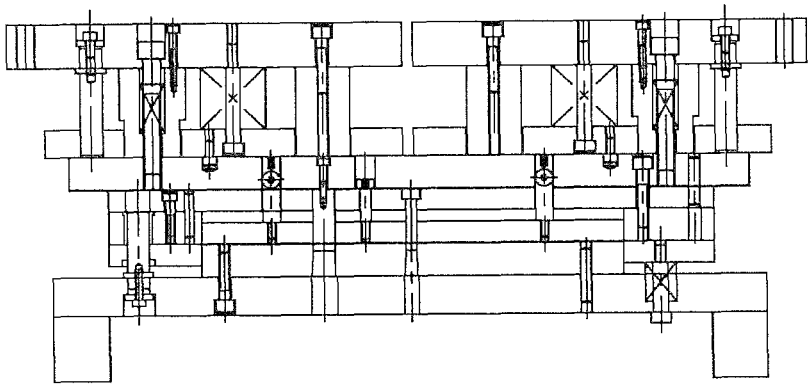
FIG. 19 is a schematic view illustrating the connection for the present invention being installed on a novel punch die of a middle or large size.

FIG. 19 is a schematic view illustrating the connection for the present invention being installed on a middle or large sized novel punch die. For a middle or large sized novel punch die, such as a die for a punch press of at least 250T, the present invention provides modular optimizing combination designs so as to fit dies of different sizes as well as to reduce weight of a single contrivance of the present invention and facilitate the use, installation, and storage thereof.

The present invention picks up the pressing and stripping function in a conventional punch die to give an independent external pressing and stripping apparatus for a punch die. This apparatus, which is independent from the die, provides enough room for the installation of an elastic or pressure element with pressing and stripping effects. The present invention, which takes place of the pressing and stripping function of the conventional punch die, is incorporated into a novel punch die so that not only the common function of the conventional punch die is ensured, but also a serious problem frequently encountered by the conventional punch die such as difficult in stripping, deformation of products, large buns, unstable product size resulting from the insufficient pressing and stripping force are effectively solved. In addition, the present invention has simplified the design of the punch die, reduced the weight, shortened the manufacturing period, and reduced the manufacturing cost. The present invention is practically designed to the standard product series according to tonnage size of the punch press. For punch presses of a same tonnage, the corresponding present invention can cooperate with the different punch dies. The present invention is easy to detach from the novel punch die and can be reutilized even when the novel punch die is obsolete, so that the present invention can be repeatedly used.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A pressing and stripping apparatus for a punch die, comprising:

a base;

a stripping bolt;

a pressing and stripping plate having a plurality through holes provided therein and being movably connected to said base via said stripping bolt;

a locating pin mounted on said pressing and stripping plate;

an elastic or pressure element, selected from a group consisting of metal spiral spring, nitrogen spring, pneumatic cylinder modular arrangement with a single piston rod, and hydraulic cylinder with a single piston rod, being provided between said base and said pressing stripping plate;

an A-type pillar, a B-type pillar having a central axial hole, a cylindrical guide column, and a square guide column, each of which having a first end and a second end, wherein said first ends of said A-type pillar, said B-type pillar, said cylindrical guide column, and said square guide column are firmly connected to said base while said second ends of said A-type pillar, said B-type pillar, said cylindrical guide column, and said square guide column are respectively passed said through holes in said pressing and stripping plate, wherein said A-type pillar and said B-type pillar are installed intervally on said base;

a die-mounting bolt, which is internally installed in said base and said central axial hole of said B-type pillar, being capable of moving upward and downward as well as rotating for firmly mounting said pressing and stripping apparatus on said punch die when in operation; and an outer supporting frame, having a cuboid shape, surrounding said pressing and stripping plate.

2. The pressing and stripping apparatus, as recited in claim 1, further comprising a first bolt, a second bolt, a third bolt, and a cylindrical steel wire compression spring, wherein a first hole, a second hole, a third screw hole, a fourth hole, a fifth hole, a twelfth hole, and a hoisting screw hole are provided in said base, wherein a sixth hole, a seventh hole, an eighth hole, a ninth hole, a tenth hole, and a guiding groove are provided in said pressing and stripping plate, wherein said A-type pillar has a first central axial screw hole provided therein and said first bolt, which passes through said second hole, is securely coupled with said first central axial screw hole of said A-type pillar, wherein an upper end of said A-type pillar is connected to said base while a lower end thereof passes through said sixth hole, wherein said stripping bolt which passes through said seventh hole has a screw end being firmly connected in said third screw hole, wherein said B-type pillar has a second central axial hole and an upper end of said die-mounting bolt is provided in said fourth hole, while a lower end thereof is provided in said second central axial hole of said B-type pillar and a middle upper end portion thereof is provided with a block ring, wherein said cylindrical steel wire compression spring is provided in said second central axial hole of said B-type pillar and said die-mounting bolt is supported by said cylindrical steel wire compression spring, wherein when said upper end of said die-mounting bolt is under pressure, said die-mounting bolt moves downward and is capable of rotating along clockwise and anticlockwise directions with respect to an axial of said die-mounting bolt, so as to install said pressing and stripping apparatus for the punch die with said pressing and stripping apparatus or detach said pressing and stripping apparatus from the punch die, wherein said B-type pillar is connected and fixed on a bottom surface of said base via said second bolt while a lower end thereof is provided in said eighth hole, wherein said cylindrical guide column has a first end fixed and mounted in said fifth hole of said base and a second end passed through said tenth hole of said pressing and stripping plate, wherein an upper end of said third bolt is provided in said twelfth hole and a lower end thereof is firmly screwed to a screw hole of said outer supporting frame, wherein said square guide column has a first end fixed and mounted in said first hole of said base and a second end passed through said guide groove at a lateral side of said pressing and stripping plate, wherein said locating pin is connected and fixed in said ninth hole.

3. The pressing and stripping apparatus, as recited in claim 2, wherein said base is provided with blind holes and at least one end of said elastic or pressure element is provided in said blind holes.

4. The pressing and stripping apparatus, as recited in claim 2, wherein said pressing and stripping plate is provided with blind holes and at least one end of said elastic or pressure element is provided in said blind holes.

5. The pressing and stripping apparatus, as recited in claim 2, wherein said base and said pressing and stripping plate are provided with blind holes and at least one end of said elastic or pressure element is provided in said blind holes.

6. The pressing and stripping apparatus, as recited in claim 1, wherein said elastic or pressure element is a pneumatic cylinder module with a single piston rod, wherein said pneumatic cylinder module which comprises a single piston rod is firmly connected to said base via said third bolt, wherein a pipe module is provided on said base, wherein said pneumatic cylinder module with said single piston rod is connected to said pipe module, wherein said pressing and stripping apparatus for a punch die further comprises an external pressure adjusting system comprising a quick-change adapter, wherein said pipe module is connected to said quick-change adapter.

7. The pressing and stripping apparatus, as recited in claim 6, wherein said external pressure adjusting system further comprises a gas storing jar, a safety valve, a first pressure adjusting valve, a gas pump, a first counting meter, and a valve, wherein said quick-change adapter is connected to said gas storing jar, wherein said gas storing jar is respectively connected to said safety valve and said valve, wherein said gas storing jar is connected to said first pressure adjusting valve, wherein said first pressure adjusting valve is connected to said gas pump, wherein said first pressure adjusting valve is connected to said first counting meter.

8. The pressing and stripping apparatus, as recited in claim 6, wherein said external pressure adjusting system further comprises a two position three way directional control valve, a gas storing jar, a safety valve, a first pressure adjusting valve, a second pressure adjusting valve, a gas pump, a first counting meter, a second counting member, and a noise damping and gas discharging device, wherein said two position three way directional control valve is respectively connected to said quick-change adapter and said gas storing jar, and is connected to said noise damping and gas discharging device through said second pressure adjusting valve, wherein said gas storing jar is respectively connected to said safety valve and said valve, and is connected to said gas pump through said first pressure adjusting valve, wherein said first pressure adjusting valve is connected to said first counting meter, wherein said second counting meter is connected to said second pressure adjusting valve.

9. The pressing and stripping apparatus, as recited in claim 1, wherein said elastic or pressure element is a hydraulic cylinder module comprising a single piston rod, wherein said hydraulic cylinder module is firmly connected to said base via said third bolt, wherein a pipe module is provided on said base, wherein said hydraulic cylinder module is connected to said pipe module, wherein said pressing and stripping apparatus further comprises an external pressure adjusting system comprising a quick-change adapter, wherein said pipe module is connected to said quick-change adapter.

10. The pressing and stripping apparatus, as recited in claim 9, wherein said external pressure adjusting system further comprises a booster, a gas storing jar, a safety valve, a valve, a first pressure adjusting valve, a first counting meter, and a gas pump, wherein said booster is connected with said quick-change adapter and said gas storing jar, wherein said gas storing jar is respectively connected to said safety valve and said valve, and is connected to said gas pump through said first pressure adjusting valve, wherein said first counting meter is connected to said first pressure adjusting valve.

11. The pressing and stripping apparatus, as recited in claim 9, wherein said external pressure adjusting system further comprises a two position three way directional control valve, a throttling valve, a first spillover valve, a second spillover valve, a hydraulic pump, a filter, a first oil tank, a second oil tank, and a third oil tank, wherein said two position three way directional control valve is respectively connected to said quick-change adapter, wherein said throttling valve and is connected to said third oil tank through said second spillover valve, wherein said throttling valve is connected to said second oil tank through said first spillover valve, and is connected to said filter through said hydraulic pump, wherein said filter is connected to said first oil tank.

* * * * *